US010903600B2

(12) United States Patent
Denz et al.

(10) Patent No.: US 10,903,600 B2
(45) Date of Patent: Jan. 26, 2021

(54) SEALED PLUG-IN CONNECTOR

(71) Applicant: Hirschmann Automotive GmbH, Rankweil/Brederis (AT)

(72) Inventors: Alexander Denz, Feldkirch (AT); Kurt Ellensohn, Feldkirch (AT)

(73) Assignee: HIRSCHMANN AUTOMOTIVE GMBH, Rankweil/Brederis (AT)

( * ) Notice: Subject to any disclaimer, the term of this patent is extended or adjusted under 35 U.S.C. 154(b) by 0 days.

(21) Appl. No.: 15/687,849

(22) Filed: Aug. 28, 2017

(65) Prior Publication Data

US 2018/0062305 A1 Mar. 1, 2018

(30) Foreign Application Priority Data

Aug. 26, 2016 (DE) ..... 10 2016 115 887

(51) Int. Cl.

| | |
|---|---|
| ***H01R 13/52*** | (2006.01) |
| ***H01R 13/432*** | (2006.01) |
| ***H01R 4/2433*** | (2018.01) |
| ***H01R 13/436*** | (2006.01) |
| ***H01R 13/44*** | (2006.01) |
| ***H01R 13/502*** | (2006.01) |

(Continued)

(52) U.S. Cl.

CPC ..... *H01R 13/5219* (2013.01); *H01R 4/2433* (2013.01); *H01R 13/432* (2013.01); *H01R 13/4362* (2013.01); *H01R 13/44* (2013.01); *H01R 13/502* (2013.01); *H01R 13/6273* (2013.01); *H01R 13/4365* (2013.01); *H01R 13/6275* (2013.01); *H01R 13/6453* (2013.01)

(58) Field of Classification Search

CPC .. H01R 13/4362; H01R 13/44; H01R 13/502; H01R 13/5219; H01R 13/6273; H01R 13/6275; H01R 13/6453; H01R 4/2433

See application file for complete search history.

(56) References Cited

U.S. PATENT DOCUMENTS 4,583,805 A * 4/1986 Mantlik ..... H01R 13/434 439/595
4,758,182 A * 7/1988 Anbo ..... H01R 13/4368 439/271
4,891,021 A * 1/1990 Hayes ..... H01R 13/114 439/595

(Continued)

FOREIGN PATENT DOCUMENTS

DE 102016208673 A 11/2016

*Primary Examiner* — Oscar J Jimenez
(74) *Attorney, Agent, or Firm* — Andrew Wilford

(57) ABSTRACT

A male plug connector having a contact support (1) with at least one contact chamber (2), wherein a contact partner (7) is mounted in the at least one contact chamber (2), wherein the contact partner (7) has a primary locking tab (10) that cooperates with its contact chamber (2), wherein a locking element (6) that can be displaced between a prelocking position and a final locking position is mounted on and/or in the contact support (2), wherein the locking element (6) is designed to secondarily lock the contact partner (7) having a secondary locking tab (12) when the contact partner (2) is located in its specified position in its contact chamber (2) and the locking element (6) has been displaced from its prelocking position into its final locking position, characterized in that, in addition to the secondary locking tab (12) of the contact partner (7), a locking web (13) that cooperates with the locking element (6) is mounted on the contact partner (7).

6 Claims, 17 Drawing Sheets

(51) Int. Cl.
*H01R 13/627* (2006.01)
*H01R 13/645* (2006.01)

(56) References Cited

U.S. PATENT DOCUMENTS 5,100,345 A * 3/1992 Endo ..... H01R 13/506 439/592
5,266,056 A * 11/1993 Baderschneider ... H01R 13/432 439/745
6,106,340 A * 8/2000 Myer ..... H01R 13/4367 439/595
6,368,165 B2 * 4/2002 Kubo ..... H01R 13/4362 439/746
6,375,501 B1 * 4/2002 Kojima ..... H01R 13/4223 439/382
6,976,874 B2 * 12/2005 Sakurai ..... H01R 4/185 439/595
7,175,483 B2 * 2/2007 Ishikawa ..... H01R 13/4362 439/752
7,182,652 B2 * 2/2007 Yamakado ..... H01R 13/4362 439/752
7,204,725 B2 * 4/2007 Yamashita ..... H01R 13/4362 439/752
7,458,863 B2 * 12/2008 Shimizu ..... H01R 13/4223 439/839
7,559,808 B2 * 7/2009 Nishide ..... H01R 13/4362 439/595
2001/0003689 A1 * 6/2001 Kim ..... H01R 13/4226 439/752
2003/0060075 A1 * 3/2003 Nakamura ..... H01R 13/4223 439/345
2004/0253881 A1 * 12/2004 Sakurai ..... H01R 4/185 439/752
2008/0009171 A1 * 1/2008 Tsuji ..... H01R 13/6272 439/352
2010/0048054 A1 * 2/2010 Okayasu ..... H01R 13/4362 439/345
2015/0214658 A1 * 7/2015 Nishiyama ..... H01R 24/76 439/357
2017/0077636 A1 * 3/2017 Nagasawa ..... H01R 13/4362

* cited by examiner

SEALED PLUG-IN CONNECTOR

FIELD OF THE INVENTION

The invention relates to a male plug connector having a contact support with at lest one contact chamber, a contact partner mounted in the contact chamber and itself having has a primary locking tab that cooperates with its contact chamber, and a locking element that can be displaced between a prelocking position and a final locking position and is mounted on and/or in the contact support and that can secondarily lock the contact partner having a secondary locking tab when the contact partner is in its specified position in its contact chamber and the locking element has been displaced from its prelocking position into its final locking position. More particularly this invention concerns such a plug connector that can be plugged together with a female plug connector.

BACKGROUND OF THE INVENTION

Plug connections are known in the art that consist of a male plug connector and a female plug connector, it being possible for the male plug connector to be detachably plugged together with the female plug connector and also unplugged therefrom.

In practice, it is necessary that the plug connection hold reliably together once the male plug connector has been plugged into the female plug connector. This is absolutely necessary for the transmission of current or signals through such a plug connection to avoid unwelcome or hazardous situations. Not only do the external forces, particularly tensile and compressive stresses, on the plug connection as a whole need to be accounted for, but rather especially tensile stresses, for example via a cable, that act on the male plug connector and the contact partner arranged in the male plug connector. Namely, if the cable on whose end the male plug connector is mounted is pulled on with a certain amount of force that can certainly occur in practice, the danger exists that a contact partner will move out of the plug and thus inevitably also detach from the contact partner in the female plug connector with which it was previously electrically engaged.

In order to prevent such detachment as effectively as possible, it has already been known to fix (lock) the contact partner in its contact chamber in the contact support of the male plug connector not only once (so-called primary locking), but also by an additional latch (so-called secondary locking).

The primary locking is achieved, for example, between the contact partner and a corresponding inner formation of the contact chamber. This is achieved, for example, by providing the contact partner with a projecting spring tab that engages in (behind) a corresponding recess in the inner surface of the contact chamber when the contact partner has been mounted in the specified manner in its end position in its contact chamber. This already effectively prevents the contact partner from moving out of its contact chamber, for instance as a result of external influences (such as for example vibration) that can occur during the normal use of the male plug connector. As a general rule, however, this primary latch is not sufficient to absorb unusual loads on the contact partner, which is where the secondary latch comes in.

Such secondary locking is achieved with an additional locking element, for example that is also referred to as a lock or CPA (Contact Position Assurance). Similarly as with the primary latch, such a locking element is used to fix the contact partner in its contact chamber in which a secondary locking tab or the like of the contact partner is supported on the locking element when the contact partner is located in its specified position in its contact chamber. Provision is made for the mounting of the contact partner in its contact chamber that it is first inserted into the contact chamber, thereby achieving the primary locking. The secondary locking is achieved by having the locking element that is initially not mounted on the male plug connector or is located in a prelocking position on the male plug connector, particularly the contact support thereof, be moved, particularly pushed, into an end position (final locking position), so that the secondary locking tab of the contact partner comes to rest against the locking element, thus ensuring that the contact partner can no longer be moved out of its contact chamber.

Such a male plug connector with primary locking and secondary locking by a lock is known from DE 10 2016 208 673.

However, it has been found in practice that, when using such plug connectors, external stresses, particularly tensile stresses on the cable can occur that, despite the primary and secondary locking of the contact partner in its contact chamber, result in the contact partner being pulled out of its contact chamber. Even if such tensile stresses were not to occur in practice, there are test specifications for minimum holding forces of the contact partner in its cohesion that must be satisfied.

BRIEF DESCRIPTION OF THE DRAWING

A male plug connector according to the invention is shown in various views and with various details in the attached drawing in which.

OBJECT OF THE INVENTION

Figure 1:
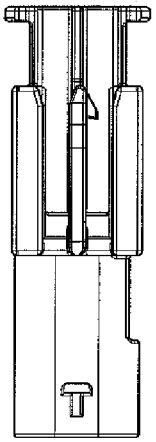
FIGS. 1-4 are side views of the contact support of this invention.
Figure 2:
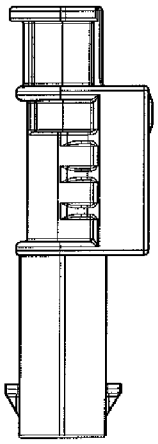
Figure 3:
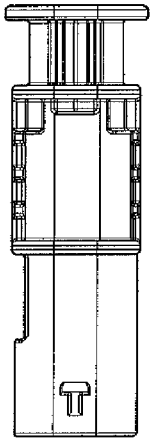
Figure 4:
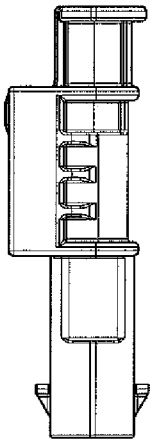

It is the object of the invention to provide a male plug connector of a plug connection that can be plugged together with a female plug connector and is mounted on one end of a cable with which greater holding forces can be achieved and that meets the relevant test specifications.

SUMMARY OF THE INVENTION

This object is achieved according to the invention in that, in addition to the secondary locking tab of the contact partner, a locking web that cooperates with the locking element is mounted on the contact partner.

The fundamental principle of the primary and secondary locking of the contact partner in its contact chamber is maintained for the time being. According to the invention, however, the secondary locking tab is reinforced by an additional element, namely a locking web on the contact partner that cooperates with the locking element. Normal holding forces can thus already be absorbed by the primary locking and secondary locking tab, and substantially greater holding forces that act against tensile stresses on the contact partner can be achieved by an additional element. This is advantageous particularly if the contact partner is manufactured from a flat metallic material as a punched bent part, since the holding forces cannot be achieved as a result of simple thickening or reinforcement of the material of the secondary locking tab. Moreover, such a locking web can be aligned precisely in the direction in which the tensile stress is acting. As a result, the tensile stresses that act on the contact partner are advantageously and effectively absorbed by same in the direction of the tensile stress and transferred to the locking element.

In an especially advantageous manner, the male plug connector according to the invention satisfies test specification LV214 prescribed by automobile manufacturers, in which it is specified that a contact partner extraction force from the housing or its contact chamber relative to only the secondary locking, must be greater than 55 Newtons.

In the context of the invention, the term "secondary locking tab" is used for any geometry of the contact partner that is suitable and intended for a secondary locking of the contact partner in its contact chamber. This can also be an offset, a block, or the like, so the secondary latch need not or need not only be embodied as a tab.

In a development of the invention, the locking web is therefore mounted and aligned on the contact partner in the longitudinal direction thereof. While the secondary locking tab is mounted and aligned transverse to the longitudinal direction of the contact partner in one embodiment, for example (with this arrangement and alignment being sufficient for a certain level of holding forces), the locking web according to the invention is aligned in the longitudinal direction, so that greater overall stability of the entire contact partner and thus a substantially better transfer of the tensile stresses on the contact partner via its locking web to the locking element is achieved. Moreover, such an elongated locking web that is aligned in the longitudinal direction of the contact partner is especially simple to implement if the contact partner is manufactured using a punching and bending process (or possibly a roller stamping process).

In a development of the invention, the locking web and the secondary locking tab are aligned and mounted at an angle to each other. For one, such an arrangement can be manufactured simply, quickly, and cost-effectively using a punching and bending process or comparable methods. For another, holding forces up to a certain order of magnitude can be achieved with the secondary locking tab that normally do not occur in practice or during the testing of the male plug connector. However, if the holding forces to be achieved during testing are greater, or if it is conceivable that such tensile stresses might occur in practice, the locking web is also mounted and aligned in a direction that is different from that of the secondary locking tab in order to enable these elevated holding forces to be absorbed.

In a special embodiment of the invention, the locking web and the secondary locking tab are aligned and mounted at about 90°, exactly 90° relative to one another. Such an arrangement advantageously enables simple manufacturing, since angling is very easy to achieve when using a punching and bending process. For another, in order to increase the holding forces, the contact partner can thus be supported substantially better on the locking element than if these two elements (locking web and secondary locking tab) were aligned in the same direction.

In a development of the invention, the locking element has a contact-supporting end that cooperates with the locking web and the secondary locking tab. This contact-supporting end brings about the abutment of the locking web and the secondary locking tab on the locking element when it has been moved from a first position, particularly its prelocking position, into the end position, particularly its final locking position. Before the locking element has been moved from its first position to its final locking position, it is possible to insert the contact partner into its contact chamber. This would not be possible if the locking element were already located in its final locking position on or in the male plug connector, more precisely on or in the contact support of the male plug connector. This means that the contact partner must first be inserted into its contact chamber before the locking element can be brought into its final locking position. This offers the additional advantage of ensuring that the function of the locking element is implemented if the contact partner has been inserted in the specified manner into its contact chamber. This is not possible beforehand, in case the locking element is already located in its final locking position. This also makes for a user-friendly assembly.

In a development of the invention, the contact-supporting end is L-shaped. As a result of this L-shape of the contact-supporting end, two contact surfaces are achieved, namely a contact surface for the secondary locking tab on the one hand and a contact surface for the locking web, preferably a front face of the locking web, on the other hand.

In a development of the invention, the locking element and/or the contact support has a guide surface on which the contact partner slides on a guide during insertion into its contact chamber. This effectively prevents the contact partner from being inserted crookedly and thus no longer properly into its contact chamber. This guide surface thus facilitates the insertion of the contact partner into its associated contact chamber. It is especially advantageous if, during the process of the insertion of the contact partner into its contact chamber, not only the contact support has a corresponding guide surface but rather the locking element is already fixed in its prelocking position on the contact support and, in turn, also has a guide surface for the contact partner. All in all, in addition to the other surfaces of the inner contour of the contact chamber, this results in an additional common guide surface during the sliding-along of the contact partner during the insertion thereof into its contact chamber.

In a development of the invention, the insertion of the contact partner into its contact chamber is increased if not only one guide surface of the contact support and of the locking element are available, but rather if the guide surfaces are aligned flush with one another when the locking element is in the prelocking position. This results in an overall guide surface that preferably extends parallel to the outer surface of the locking web, so that, as a result of this abutment of the mutually facing surfaces, the contact partner is guided optimally when it is inserted into its contact chamber.

SPECIFIC DESCRIPTION OF THE INVENTION

Insofar as shown in detail, FIGS. 1 to 9 show various views of a contact support 1. This contact support 1 is a component of a male plug connector (not shown in further detail).

Figure 5:
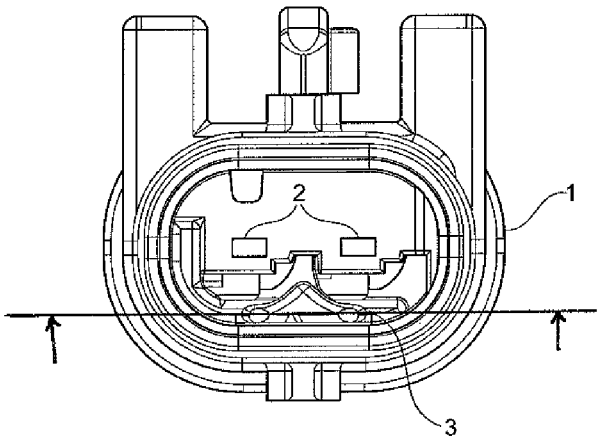
FIGS. 5 and 6 are large-scale end views of the contact support.
Figure 6:
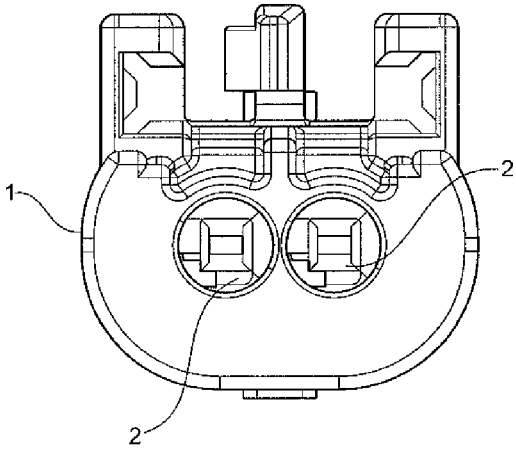

With reference to FIGS. 5 and 6, it can be seen that the contact support 1 has at least one contact chamber, in this embodiment, two adjoining contact chambers 2. More than two contact chambers can also be provided in a row or even several contact chambers in rows over one another, that is, parallel to each other.

The contact support 1 has a receiving geometry 3 (FIG. 5) into which a locking element (to be illustrated and described later) for secondary locking can be inserted.

Figure 7:
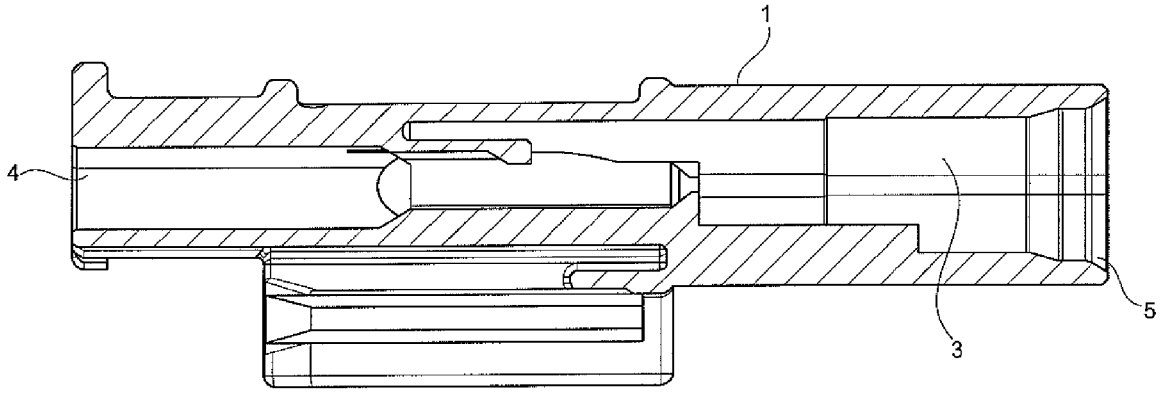
FIGS. 7 is a large-scale longitudinal section through the contact support.

With reference particularly to FIG. 7, the contact support 1 has an outgoing cable end 4 and, at its opposite end, a connector face 5. An electrical cable (not shown) is inserted via the outgoing cable end 4, with a contact partner mounted on each electrical conductor of the cable that is inserted from the outgoing cable end 4 toward the contact support 1 and fixed there. A female plug connector (not shown), preferably its contact support, is inserted into the contact support 1 from the direction of the connector face 5. During this insertion, a plug connection consisting of plug connector and female plug connector is achieved, with each contact partner of the male plug connector corresponding and being plugged together with each contact partner of the female plug connector in order to create an electrical connection.

Figure 8:
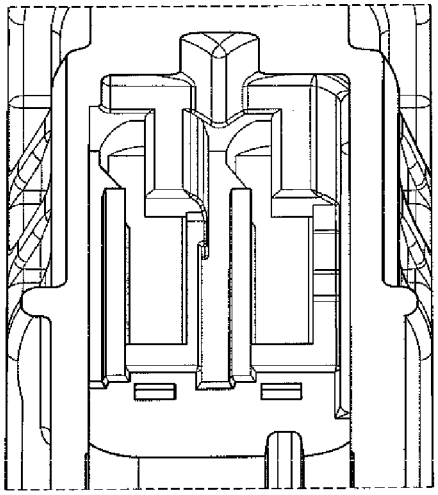
FIGS. 8 and 9 are large-scale detail sectional views corresponding to FIGS. 5 and 6 and showing internal structures of the contact support.
Figure 9:
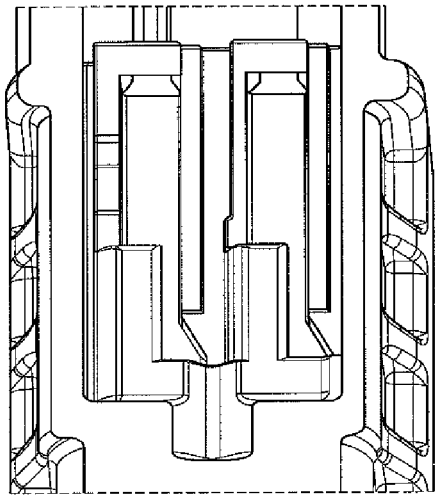

FIGS. 8 and 9 show sections through the contact support 1 according to FIGS. 5 and 6.

Figure 10:
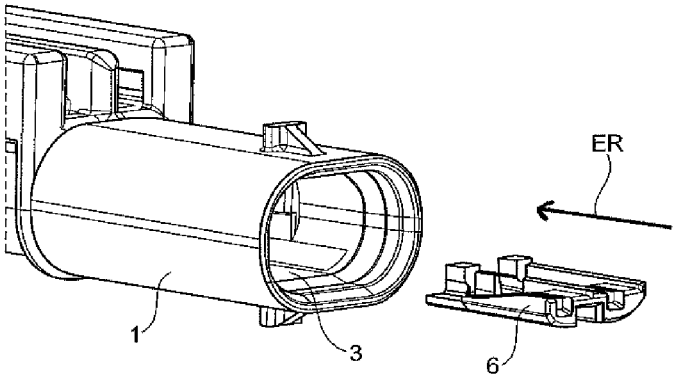
FIGS. 10 and 11 are respectively an unassembled perspective end view and an assembled perspective end view of the contact support.
Figure 11:
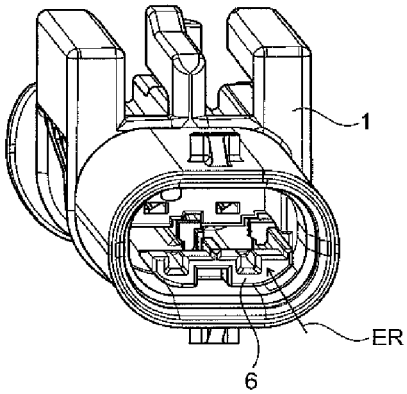
Figure 12:
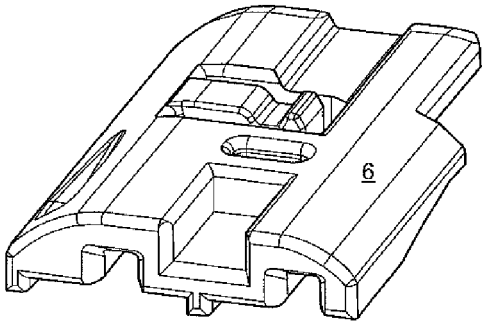
FIGS. 12 and 13 are top and bottom perspective views of part of the locking element of this invention.
Figure 13:
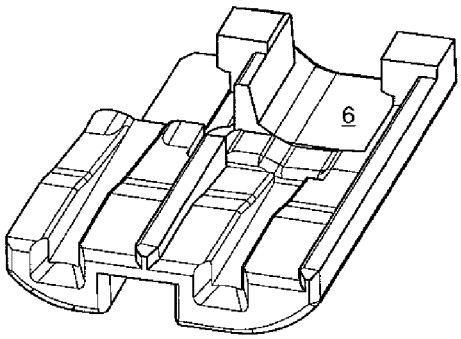
Figure 14:
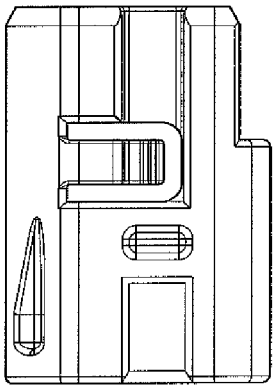
FIGS. 14-17 are side views of the locking element.
Figure 15:
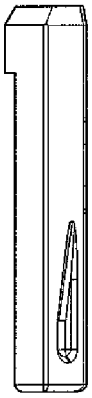

FIGS. 10 and 11 show the contact support 1 again into which a locking element 6 for secondary locking can be inserted in a direction of insertion ER. While FIG. 10 shows that the locking element 6 has not yet been inserted into the contact support 1 and preferably brought there into a prelocking position, FIG. 11 shows that the locking element 6 has been pushed in the direction of insertion ER into the interior of the contact support 1, particularly in the direction of its receiving geometry 3, and fixed there in a prelocking position. In FIG. 11, the locking element 6 is not yet in its prelocking position. The prelocking position is only reached when the locking element 6 (also to be referred to as a lock) has been mounted (inserted and locked) completely in the contact support 1 at its final stop.

FIGS. 12 to 17 show various views of the locking element 6. As can be seen, the locking element 6 has geometries that are adapted, for one, to the receiving geometry on the interior of the contact support 1. These geometries effect a guided insertion of the locking element 6 into the receiving geometry 3 of the contact support 1 in direction of insertion ER. Moreover, the geometries of the locking element 6, in conjunction with corresponding geometries within the contact support 1, have the effect that the locking element 6 can be fixed there in a prelocking position and brought from the prelocking position into the final locking position under application of a force. This can but need not be possible only when the respective contact partner has been inserted into its associated contact chamber within the contact support 1. This means that displacement of the locking element 6 would be possible even if the contact partners 2 (e.g., pin contacts) were not mounted beforehand.

Figure 18:
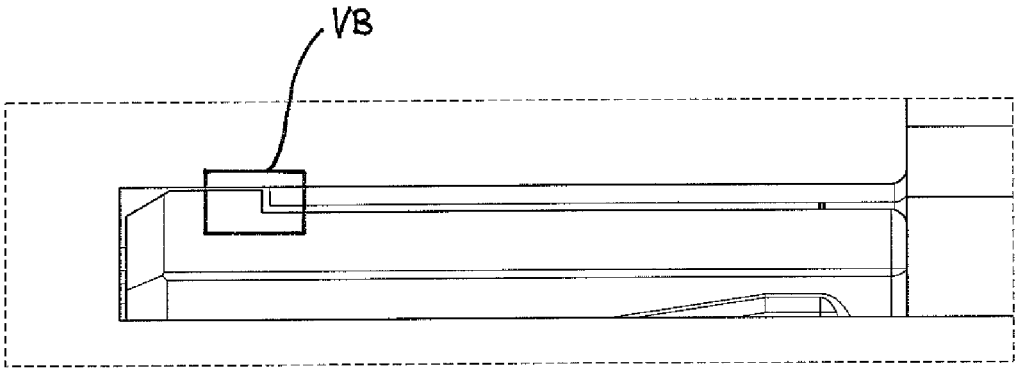
FIGS. 18 shows the locking element in a pre-locking position.
Figure 19:
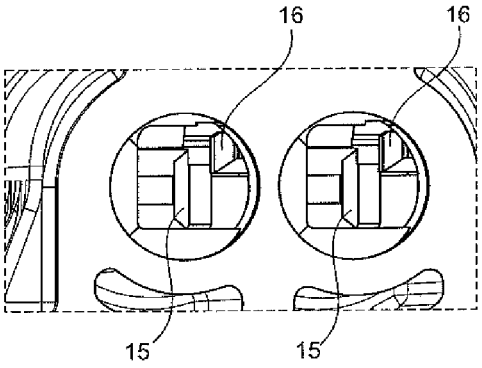
FIGS. 19 to 24 are various views showing how the locking elements fits in and with the contact support in the prelocking position.
Figure 20:
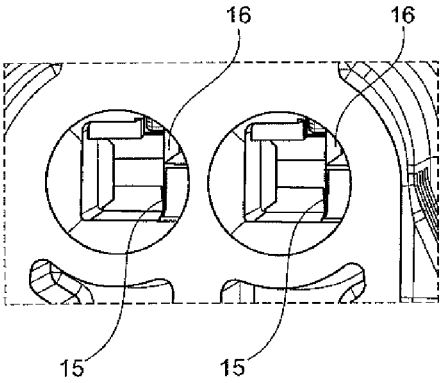
Figure 21:
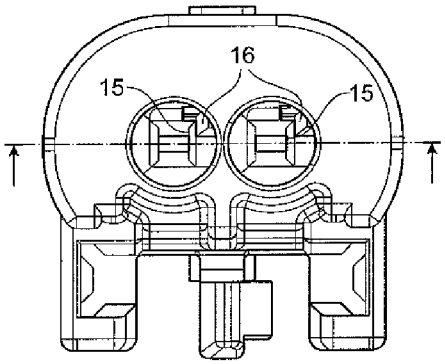
Figure 22:
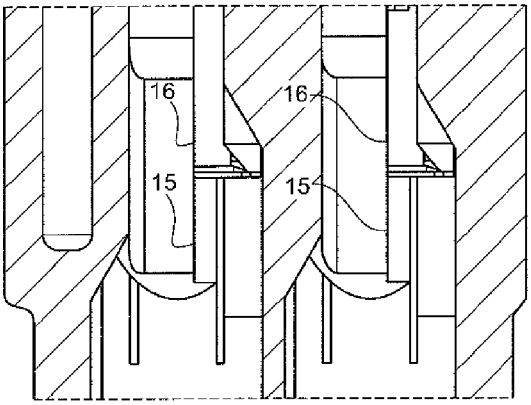
Figure 23:
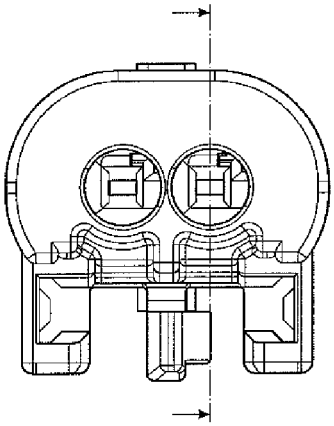
Figure 24:
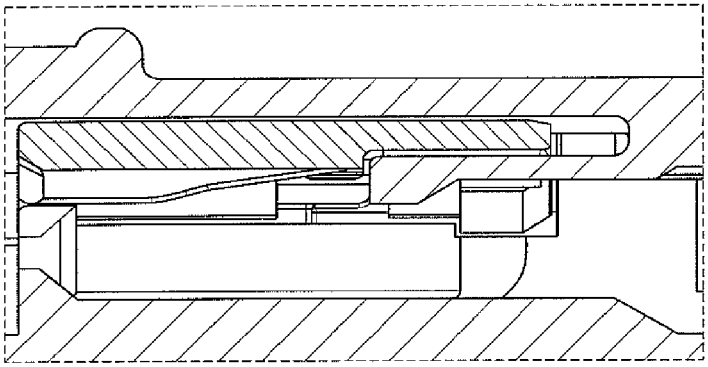

FIG. 18 shows a situation in which the locking element 6 has been mounted in its prelocking position within the contact support 1. During the mounting of the locking element 6 (also called lock), the contact support 1 (also called plug sleeve) is expanded on the interior thereof. As soon as the locking element 6 has reached its end position, it locks in place in the area marked with the rectangle (locking area VB). Instead of this locking as represented by an undercut, it is conceivable for a spring element or this function to be implemented with the snap-in element (prelocking and final locking position) on the locking element 6.

Expansion occurs when the locking element 6 has been pushed in from the outside. During displacement of the locking element 6 from its prelocking to its final locking position, the deflection is normally achieved by a locking hook on the locking element 6. Alternatively, however, solutions can also be set up in which the wall of the contact support 2 also expands during the displacement of the locking element 6.

FIGS. 19 to 24 show in various views that the locking element 6 is located within the contact support in the prelocking position. It is thus possible for every contact partner (not shown here yet) to be inserted into its associated contact chamber 2 within the contact support 1, particularly from the direction of the outgoing cable end 4 toward the connector face 5.

The reference numbers in FIGS. 19 to 28 will be explained later in connection with the contact partner.

Figure 25:
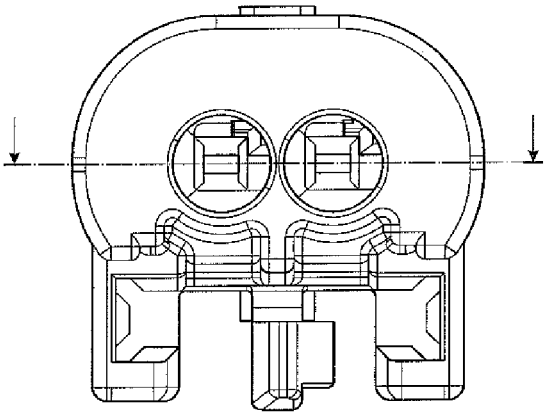
FIGS. 25 and 26 show further illustrate the interfit of the locking element and contact support, as well as the position of the contact partner between them.
Figure 26:
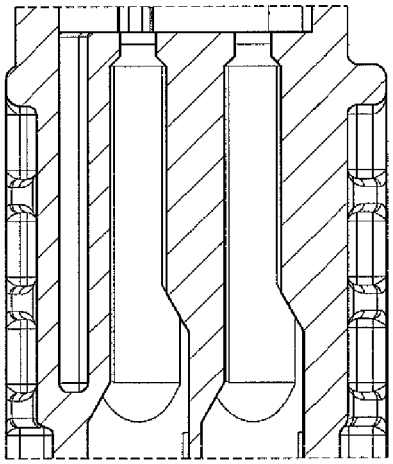
Figure 27:
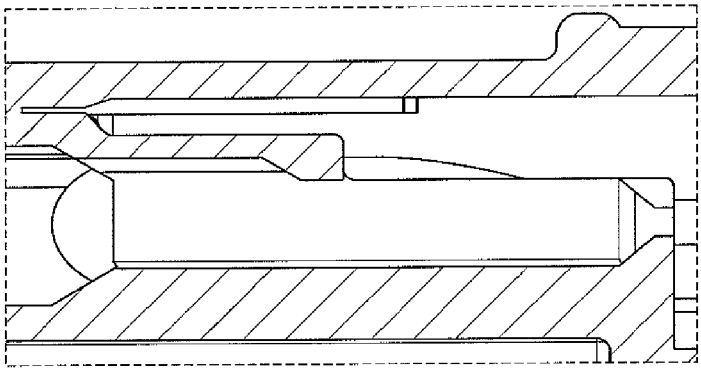
FIGS. 27-30 illustrate further details of the interfitted locking element and contact partner, and contact support.
Figure 28:
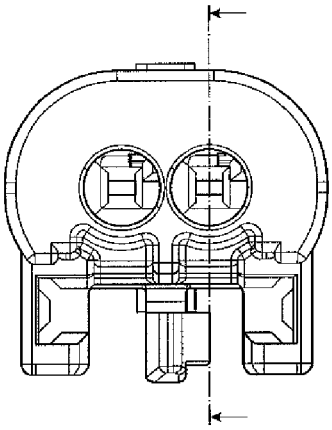

FIGS. 25 and 26 show the optimal coordination of the guidance and the placement of the contact partner between the contact support and the locking element 6 (lock).

Figure 29:
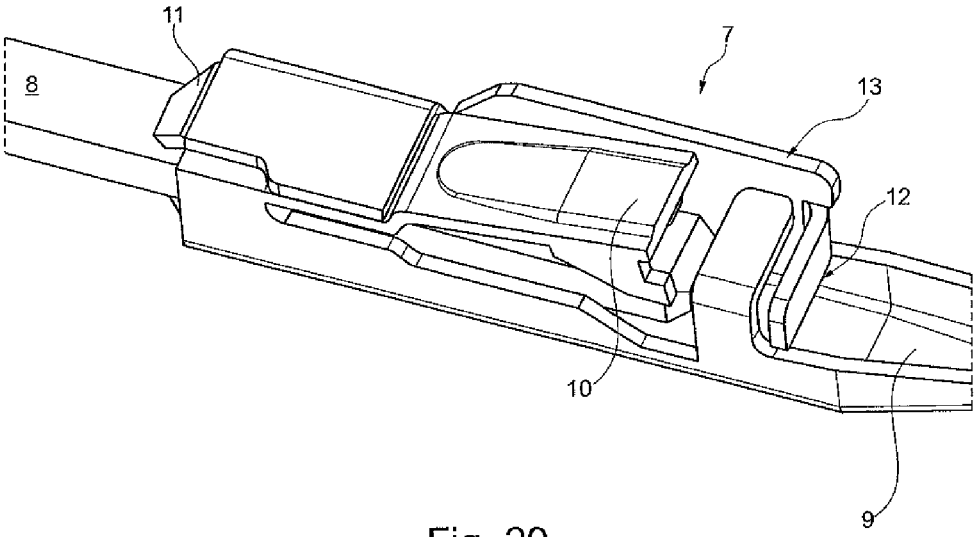

FIG. 29 shows an embodiment of an electrical contact partner 7 that is preferably manufactured by a punching and bending process or a roller stamping process. This contact partner 7 has a contact pin 8, for example, that is mounted in the vicinity of the connector face 5 within the contact support 1, so that it looks out of the contact chamber 2. A contact area 9 is shown on the opposite site that is designed and suitable for fixing the contact partner 7 in a suitable manner on an electrical conductor. This can be achieved by soldering or welding or also by a crimp connection, for example.

It is essential for the invention that the contact partner have an element for primary locking with which it can be primarily locked within the contact chamber 2 of the contact support 1 when it is located in its specified, that is, final position within the contact chamber 2 after insertion. In this case, the element is embodied as a primary locking tab 10 for this purpose that projects from the contact partner 7. If the contact partner 7 is inserted into its contact chamber 2, the primary locking tab 10 is deformed in an elastically resilient manner and slides with its end along the inner contour of the contact chamber 2. Once the end position of the contact partner 2 in its contact chamber 3 has been reached, the end of the primary locking tab 10 can spring back into a corresponding recess in the inner geometry of the contact chamber 3, so that the front face of the primary locking tab 10 engages behind this inner geometry (offset), thereby preventing the contact partner 7 from being pulled out of its contact chamber 2. In order to ensure a defined insertion of the contact partner 7 into its contact chamber 2, a stop 11 can but need not be present that comes to rest against one end of the contact chamber 2 when the contact partner 7 has been inserted into its end position in its contact chamber 2.

What is substantially more important for achieving the required holding forces is not only the presence of the inherently known secondary locking tab 12, but also the presence of the locking web 13 according to the invention, which also performs the secondary locking of the contact partner 7 in its contact chamber 2. In this embodiment, while the secondary locking tab 12 is aligned approximately transversely to the longitudinal axis of the contact partner 7, the locking web 13 is aligned parallel to the longitudinal axis of the contact partner 7.

Figure 30:
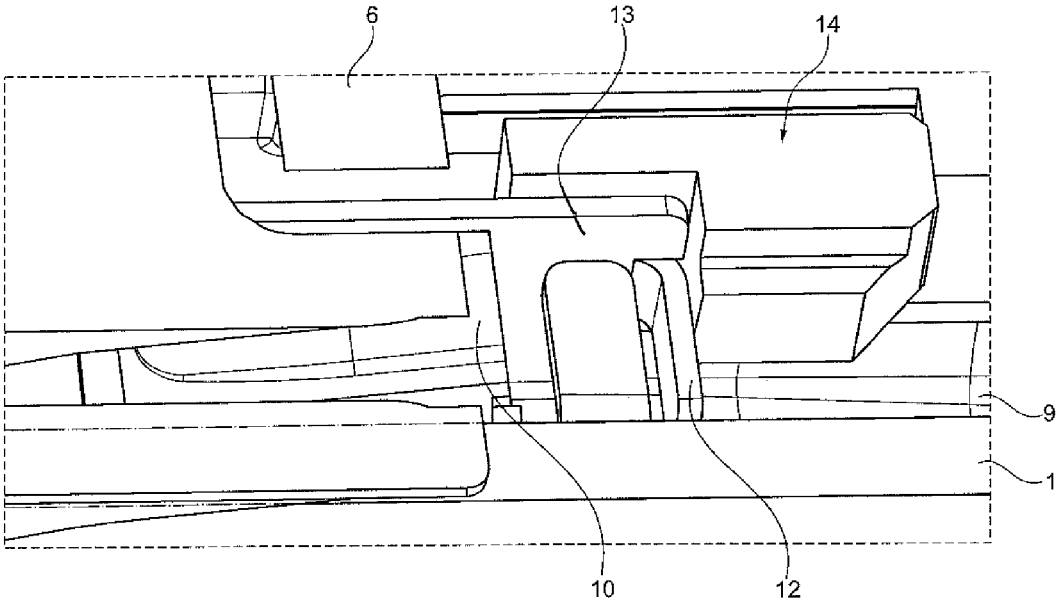

FIG. 30 shows how the contact partner 7 is inserted into its contact chamber 2 of the contact support 1 and, above all, how the secondary locking elements cooperate with the locking element 6. For one, the secondary locking tab 12 and the locking web 13 can be seen. For another, it can be seen that the locking element 6 has a contact-supporting end 14. This contact-supporting end 14 of the locking element 6 in its final locking position has the effect that not only the secondary locking tab 12 rests against this contact-supporting end 14 at least partially, optionally also completely, but also the locking web 13, particularly its front face that faces in the longitudinal direction of the contact partner 7. While certain holding forces are already achieved with the abutment of at least a portion of the secondary locking tab 12 against the contact-supporting end 14, these holding forces are increased substantially by virtue of the fact that the locking web 13, particularly its front face, also rests against the contact-supporting end 14.

Figure 31:
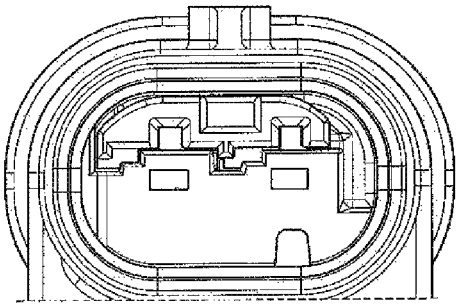
FIGS. 31 and 32 show the locking element in its prelocking position in the contact support seen in opposite longitudinal directions.
Figure 32:
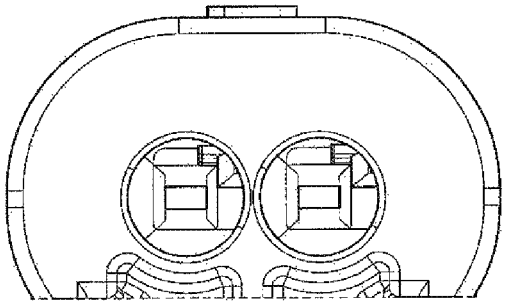
Figure 33:
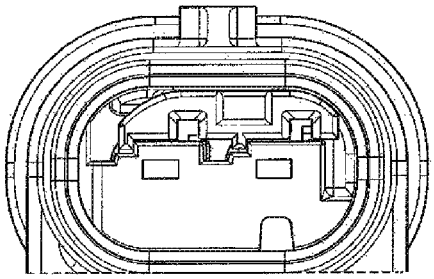
FIG. 33 and 34, like FIGS. 31 and 32, show the locking element and contact support in the locking position.
Figure 34:
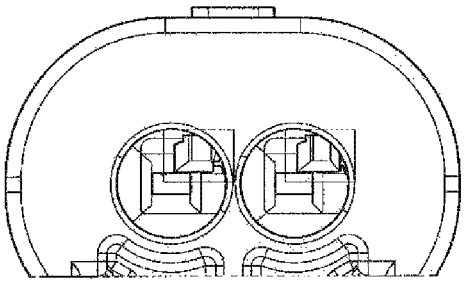

For the sake of completeness, FIGS. 31 and 32 show the locking element 6 in its prelocking position in the contact support 1, particularly looking toward the connector face 5 (FIG. 31) and toward the outgoing cable end 4 (FIG. 32).

Analogously to FIGS. 31 and 32, FIGS. 33 and 34 show the locking element 6 in its final locking position, it being made clear by the rectangles that are drawn in that not only has the locking element 6 been displaced, but rather that the contact-supporting end 14 has also become operative as a result for the contact partner that, for the sake of clarity, is not drawn in here.

With reference to FIGS. 19 to 28, it should also be mentioned that, for the purpose of optimally guidance during the placement of the contact partner 7 into its contact chamber 2, the respective contact chamber 2 has a guide surface 15, and the locking element 6 also has its own guide surface 16. Ideally, these two guide surfaces 15, 16 are mounted flush with one another that can be seen very well particularly in FIG. 22.

Figure 16:
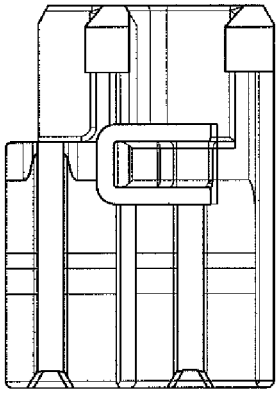
Figure 17:
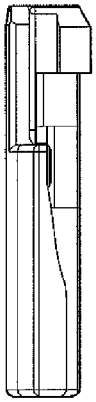

The guide surface 16 can be seen at the top of FIG. 16 (lead-in chamfer on the left side of the respective secondary locking web).

In particular, the plug itself does not have a seal element. The respective seal is achieved only by the single-wire seals on the contact partners of plug connector and female plug connector (particularly, pin and socket contacts) and by a seal between plug connector and female plug connector.

Figure 35:
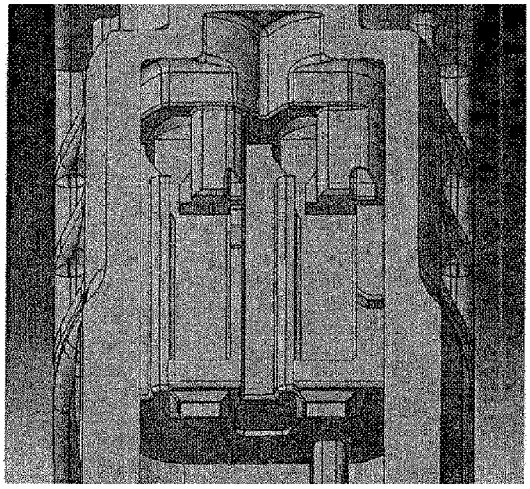
FIGS. 35 and 36 are large scale perspective views of part of another contract support according to the invention.
Figure 36:
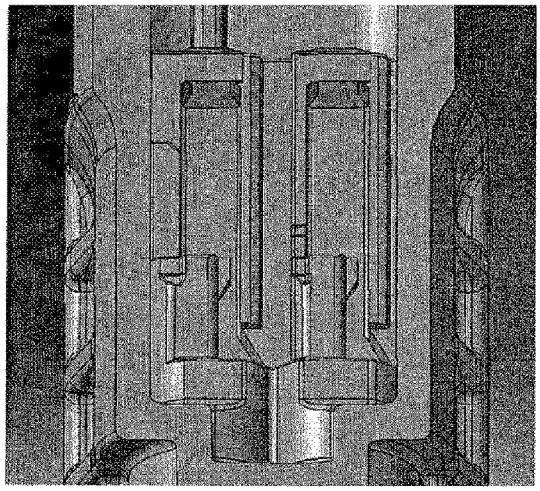
Figure 37:
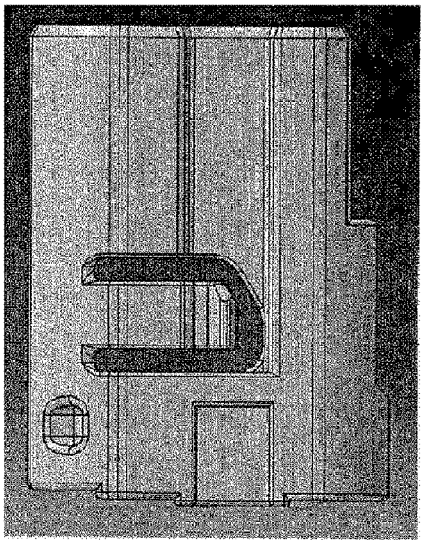
FIGS. 37-39 are slide view of the other contact support shown in FIGS. 35 and 36.
Figure 38:
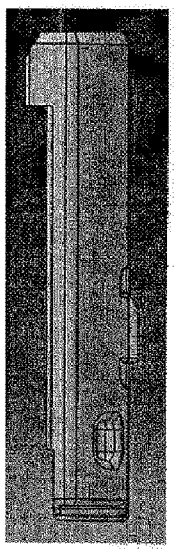
Figure 39:
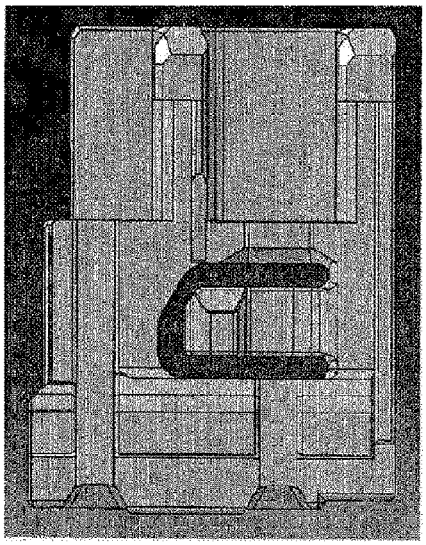

FIGS. 35 and 39 show another embodiment of the contact support 2. This includes the locking element 6. Although the geometry of contact support 2 and locking element 6 is somewhat different in FIGS. 35 to 39 than in the embodiment that is illustrated in FIGS. 1 to 34, the same functionality and aim is achieved.

The invention claimed is:

1. A sealed male plug connector comprising:

a contact support with a longitudinally open contact chamber;

a contact partner mounted in the contact chamber and having a primary locking tab that cooperates with the contact chamber and a secondary locking tab;

a locking element that has a contact-supporting end, can be transversely displaced between a prelocking position and a final locking position, is mounted on or in the contact support, and is designed to secondarily lock the contact partner when the contact partner is located in a predetermined position in the contact chamber and the locking element has been displaced from its prelocking position into its final locking position, the contact support and contact partner being so constructed that when fitted together in the final locking position of the locking element the chamber is sealed; and a longitudinally extending locking web that cooperates with the contact-supporting end of the locking element and is fixed on the contact partner in a position with a locking hook holding the secondary locking tab in the final locking position when displaced from the prelocking position into the final locking position.

2. The male plug connector defined in claim 1, wherein the locking web and the secondary locking tab are aligned and mounted so as to extend at an angle to each other.

3. The male plug connector defined in claim 2, wherein the locking web and the secondary locking tab are aligned and mounted so as to extend 90° relative to one another.

4. The male plug connector defined in claim 1, wherein the contact-supporting end is L-shaped.

5. The male plug connector defined in claim 1, wherein the locking element or the contact support has a guide surface along which the contact partner slides in a guided manner during insertion into its contact chamber.

6. The male plug connector defined in claim 5, wherein the guide surfaces are aligned flush with one another when the locking element is in the prelocking position.

* * * * *